US012209430B2

(12) United States Patent
Hodak

(10) Patent No.: US 12,209,430 B2
(45) Date of Patent: Jan. 28, 2025

(54) CLOSURE FOR SWIMMING POOL SKIMMER

(71) Applicant: Michael L. Hodak, Venetia, PA (US)

(72) Inventor: Michael L. Hodak, Venetia, PA (US)

(73) Assignee: Michael L. Hodak, Venetia, PA (US)

( * ) Notice: Subject to any disclaimer, the term of this patent is extended or adjusted under 35 U.S.C. 154(b) by 80 days.

(21) Appl. No.: 17/895,109

(22) Filed: Aug. 25, 2022

(65) Prior Publication Data

US 2024/0068256 A1 Feb. 29, 2024

(51) Int. Cl.

| | |
|---|---|
| ***E04H 4/00*** | (2006.01) |
| ***E04H 4/12*** | (2006.01) |
| ***E04H 4/14*** | (2006.01) |

(52) U.S. Cl.

CPC ..... *E04H 4/14* (2013.01); *E04H 4/1272* (2013.01)

(58) Field of Classification Search

CPC ..... E04H 4/1272; E04H 4/14

See application file for complete search history.

(56) References Cited

U.S. PATENT DOCUMENTS

| | | | | |
|---|---|---|---|---|
| 7,011,747 | B2 * | 3/2006 | Hodak | E04H 4/1272 210/232 |
| 10,400,505 | B2 * | 9/2019 | Hodak | E06B 3/01 |
| 10,407,928 | B2 * | 9/2019 | Lafontaine | E04H 4/1272 |
| 11,708,701 | B1 * | 7/2023 | Erbes | E04H 4/1272 210/167.1 |

* cited by examiner

*Primary Examiner* — Daniel J Troy
*Assistant Examiner* — Daniel Alvarez
(74) *Attorney, Agent, or Firm* — The Webb Law Firm

(57) ABSTRACT

A sealing closure assembly for closing a skimmer opening of a swimming pool includes a closure faceplate having a sidewall and a flange protruding from the sidewall. The sealing closure assembly further includes a cover removably connectable to the closure faceplate. The cover includes a cover plate configured for engaging at least a portion of the sidewall of the closure faceplate, and at least one closure member for locking the cover plate to the closure faceplate. The closure member includes a body having a first end connected to the cover plate and a second end protruding relative to the first end. The second end of the at least one closure member is deflectable relative to the first end. A locking member between the first end and the second end is configured for engaging with the flange of the closure faceplate when the cover is connected to the closure faceplate.

18 Claims, 5 Drawing Sheets

CLOSURE FOR SWIMMING POOL SKIMMER

BACKGROUND OF THE INVENTION

Field of the Invention

The present invention relates generally to swimming pools and, more particularly, to a sealing closure for closing a skimmer opening to prevent water from entering the skimmer when the swimming pool is closed for the season.

Brief Description of the Prior Art

It is common to employ one or more skimming devices in the sidewalls of swimming pools, hot tubs, and the like to permit surface water to be drawn off by a pump, to be filtered at a remote location and then optionally heated, and returned to the pool through one or more return ports. While the present disclosure focuses on skimming devices for swimming pools, it is to be understood that various other water structures, including, without limitation, hot tubs, spas, jet tubs, and the like can have similar or identical skimming devices. These skimming devices have a skimmer opening in a side wall of the pool for drawing the surface water to the pump. During normal use of the pool, the surface level of the water in the pool is at the same level as the skimmer opening such that water from the surface can enter the skimmer opening. When the pool is closed, for example during the winter season, it is sometimes desirable to maintain a lower level of water in the pool for structural purposes. Even if completely drained, the water level in the pool will naturally rise during the closed season due to rainwater and melting snow, such that the water level oftentimes rises to a level of the skimmer opening or above. In such cases, it is necessary to close off the skimmer opening to prevent backflow of water through the skimmer opening and the conduits that connect the skimmer opening to the filter, pump equipment, and heater so as to prevent damage to these components due to freezing.

Within the prior art, one way of closing the skimmer opening is to employ an elongated, plug-like element. The plug element is threadably secured within the floor of the skimmer body to seal the conduit communicating with the pump and filtration equipment. In other embodiments, a detachable cover plate or panel is removably attachable to the skimmer opening. Some of these existing devices either require a retrofit of the skimmer faceplate in order to make sealing contact with a closure member. Other known devices require the use of a polymeric flexible sealing member which snaps over the skimmer opening. Such faceplate seals may lose their effectiveness due to weathering of the polymeric material, and also may require special retrofitting of the skimmer opening member to provide better sealing between the skimmer and the flexible snap-on faceplate. In addition, the existing faceplate seals may crack or be otherwise compromised due to temperature-related shirking and/or contact with ice. Furthermore, due to the conventional square or rectangular shape of the skimmer opening, the existing devices for closing the skimmer opening may not provide an adequate seal in the corners of such skimmer openings. Accordingly, there is a need in the art for an improved sealing closure for the skimmer opening that overcomes the deficiencies of the prior art.

SUMMARY OF THE INVENTION

In view of the existing need in the art, it would be desirable to develop a sealing closure assembly for a swimming pool skimmer opening that overcomes the deficiencies associated with the existing devices.

In accordance with some preferred and non-limiting embodiments or aspects of the present disclosure, a sealing closure assembly for closing a skimmer opening of a swimming pool may include a closure faceplate and a cover. The closure faceplate may include a sidewall with a central opening shaped to correspond to the skimmer opening, and a flange protruding from the sidewall to overlap a peripheral area of the skimmer opening. The cover may be removably connectable to the closure faceplate to seal the central opening of the closure faceplate. The cover may include a cover plate configured for engaging at least a portion of the sidewall of the closure faceplate, and at least one closure member on the cover plate for locking the cover plate to the closure faceplate. The at least one closure member may include a body having a first end connected to the cover plate and a second end protruding relative to the first end. The second end of the at least one closure member may be deflectable relative to the first end. A locking member may be provided between the first end and the second end. The locking member may be configured for engaging with the flange of the closure faceplate when the cover is connected to the closure faceplate.

In accordance with some preferred and non-limiting embodiments or aspects of the present disclosure, the locking member may be a notch protruding from the body of the at least one closure member. The at least one locking member may be four locking members positioned to engage four corners of the flange of the closure faceplate. The second end of the at least one closure member may be resiliently deflectable relative to the first end.

In accordance with some preferred and non-limiting embodiments or aspects of the present disclosure, a sealing gasket may extend around an inner surface of the cover plate. The sealing gasket may be dimensioned such that a shape of the sealing gasket corresponds to a shape of the sidewall of the closure faceplate. The sealing gasket may be configured for abutting the sidewall of the closure faceplate when the cover is connected to the closure faceplate. The sealing gasket may be molded over the cover plate. The sealing gasket may be monolithically formed with the cover plate. The sealing gasket may be made of a thermoplastic elastomer material.

In accordance with some preferred and non-limiting embodiments or aspects of the present disclosure, there may be one or more locking elements on the flange for connecting to a peripheral flange on the skimmer opening. Each of the one or more locking elements may be formed on an outer periphery of the flange. The closure faceplate may have one or more radiused corners defining the central opening. A radius of the one or more radiused corners may be between 0.25 inches and 1 inches. The closure faceplate and cover plate may be made of an injection molded plastic material.

In accordance with some preferred and non-limiting embodiments or aspects of the present disclosure, a cover element for closing a skimmer opening of a swimming pool skimmer may include a cover plate configured for engaging at least a portion of a sidewall of a closure faceplate, and at least one closure member on the cover plate for locking the cover plate to the closure faceplate. The at least one closure member may include a body having a first end connected to the cover plate and a second end protruding relative to the first end. The second end of the at least one closure member may be deflectable relative to the first end. A locking member may be provided between the first end and the second end. The locking member may be configured for engaging with the flange of the closure faceplate when the cover is connected to the closure faceplate.

In accordance with some preferred and non-limiting embodiments or aspects of the present disclosure, the locking member may be a notch protruding from the body of the at least one closure member. The second end of the at least one closure member may be resiliently deflectable relative to the first end.

In accordance with some preferred and non-limiting embodiments or aspects of the present disclosure, a sealing gasket may extend around an inner surface of the cover plate. The sealing gasket may be made of a thermoplastic elastomer material. The cover plate may be made of an injection molded plastic material.

In accordance with other preferred and non-limiting embodiments or aspects of the present disclosure, the sealing closure assembly may be defined by one or more of the following clauses:

Clause 1. A sealing closure assembly for closing a skimmer opening of a swimming pool, the sealing closure assembly comprising: a closure faceplate comprising: a sidewall with a central opening shaped to correspond to the skimmer opening; and a flange protruding from the sidewall to overlap a peripheral area of the skimmer opening, and a cover removably connectable to the closure faceplate to seal the central opening of the closure faceplate, the cover comprising: a cover plate configured for engaging at least a portion of the sidewall of the closure faceplate; and at least one closure member on the cover plate for locking the cover plate to the closure faceplate, the at least one closure member comprising: a body having a first end connected to the cover plate and a second end protruding relative to the first end, wherein the second end of the at least one closure member is deflectable relative to the first end; and a locking member between the first end and the second end, the locking member configured for engaging with the flange of the closure faceplate when the cover is connected to the closure faceplate.

Clause 2. The sealing closure assembly of clause 1, wherein the locking member is a notch protruding from the body of the at least one closure member.

Clause 3. The sealing closure assembly of clause 1 or 2, wherein the at least one locking member is four locking members positioned to engage four corners of the flange of the closure faceplate.

Clause 4. The sealing closure assembly of any of clauses 1 to 3, wherein the second end of the at least one closure member is resiliently deflectable relative to the first end.

Clause 5. The sealing closure assembly of any of clauses 1 to 4, further comprising a sealing gasket extending around an inner surface of the cover plate.

Clause 6. The sealing closure assembly of clause 5, wherein the sealing gasket is dimensioned such that a shape of the sealing gasket corresponds to a shape of the sidewall of the closure faceplate, and wherein the sealing gasket is configured for abutting the sidewall of the closure faceplate when the cover is connected to the closure faceplate.

Clause 7. The sealing closure assembly of clause 5 or 6, wherein the sealing gasket is molded over the cover plate.

Clause 8. The sealing closure assembly of any of clauses 5 to 7, wherein the sealing gasket is monolithically formed with the cover plate.

Clause 9. The sealing closure assembly of any of clauses 5 to 8, wherein the sealing gasket is made of a thermoplastic elastomer material.

Clause 10. The sealing closure assembly of any of clauses 1 to 9, further comprising one or more locking elements on the flange for connecting to a peripheral flange on the skimmer opening.

Clause 11. The sealing closure assembly of any of clauses 1 to 10, wherein each of the one or more locking elements is formed on an outer periphery of the flange.

Clause 12. The sealing closure assembly of any of clauses 1 to 11, wherein the closure faceplate has one or more radiused corners defining the central opening.

Clause 13. The sealing closure assembly of clause 12, wherein a radius of the one or more radiused corners is between 0.25 inches and 1 inches.

Clause 14. The sealing closure assembly of any of clauses 1 to 13, wherein the closure faceplate and cover plate are made of an injection molded plastic material.

Clause 15. A cover element for closing a skimmer opening of a swimming pool skimmer, the cover element comprising: a cover plate configured for engaging at least a portion of a sidewall of a closure faceplate; and at least one closure member on the cover plate for locking the cover plate to the closure faceplate, the at least one closure member comprising: a body having a first end connected to the cover plate and a second end protruding relative to the first end, wherein the second end of the at least one closure member is deflectable relative to the first end; and a locking member between the first end and the second end, the locking member configured for engaging with the flange of the closure faceplate when the cover is connected to the closure faceplate.

Clause 16. The cover element of clause 15, wherein the locking member is a notch protruding from the body of the at least one closure member.

Clause 17. The cover element of clause 15 or 16, wherein the second end of the at least one closure member is resiliently deflectable relative to the first end.

Clause 18. The cover element of any of clauses 15 to 17, wherein the cover plate is made of an injection molded plastic material.

Clause 19. The cover element of any of clauses 15 to 18, further comprising a sealing gasket extending around an inner surface of the cover plate.

Clause 20. The cover element of clause 19, wherein the sealing gasket is made of a thermoplastic elastomer material.

These and other features and characteristics of the present disclosure, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

In FIGS. 1-10, the same characters represent the same components unless otherwise indicated.

DETAILED DESCRIPTION OF INVENTION

Figure 1:
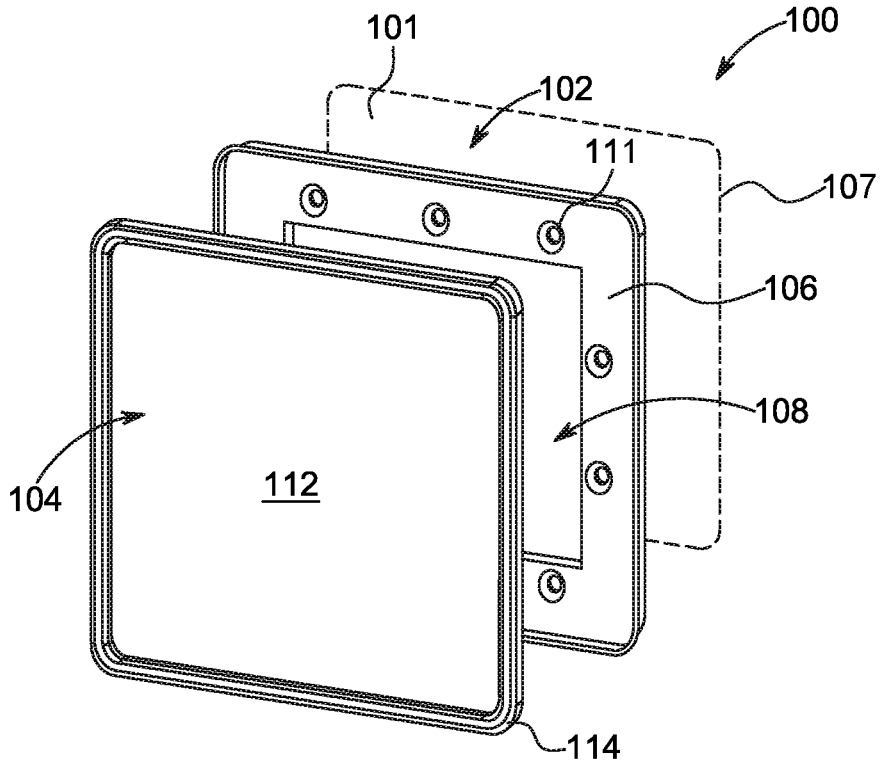
FIG. 1 is an exploded perspective view of a sealing closure assembly in accordance with some embodiments or aspects of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The word "comprising" and "comprises", and the like, does not exclude the presence of elements or steps other than those listed in any claim or the specification as a whole. In the present specification, "comprises" means "includes" and "comprising" means "including".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular", "transverse", "substantially perpendicular", or "substantially transverse" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

With reference to FIG. 1, a sealing closure assembly 100 is configured for use with a skimmer (not shown) of a pool, spa, hot tub, or the like. The sealing closure 100 is configured to close a skimmer opening 101 and prevent water from entering the skimmer opening 101. Typically, the skimmer is mounted on a pool sidewall. The skimmer has a peripheral flange 107 that defines the skimmer opening 101. The peripheral flange 107 may be secured to the pool sidewall by fasteners (not shown) or other mechanical means. Surface water from the pool is drawn through the skimmer opening 101 for subsequent pumping, filtration, and heating purposes. At least a portion of the sealing closure assembly 100 is configured to interact with the skimmer opening 101 so as to block the skimmer opening 101 and prevent the passage of water therethrough.

Figure 2:
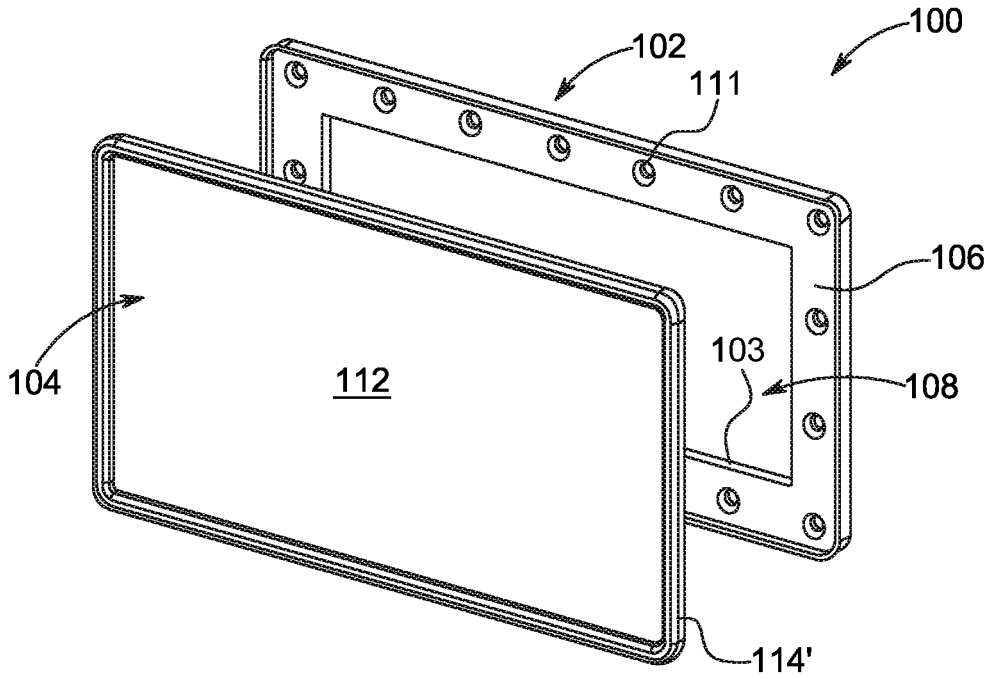
FIG. 2 is an exploded perspective view of a sealing closure assembly in accordance with some embodiments or aspects of the present disclosure.

With reference to FIGS. 1-2, the sealing closure assembly 100 includes a closure faceplate 102 and a cover 104 configured for removably connecting to the closure faceplate 102. The closure faceplate 102 is configured to be connected to the skimmer opening 101 on the pool or water side of the skimmer. The closure faceplate 102 has a generally square or rectangular shape, at least a portion of which is dimensioned to fit inside the skimmer opening 101. Desirably, an outer shape of at least a portion of the closure faceplate 102 is shaped to correspond to the shape of the skimmer opening 101. In some aspects, the closure faceplate 102 may be installed directly on the sidewall of the pool. In other aspects, the closure faceplate 102 may be installed over the skimmer peripheral flange 107.

Figure 3:
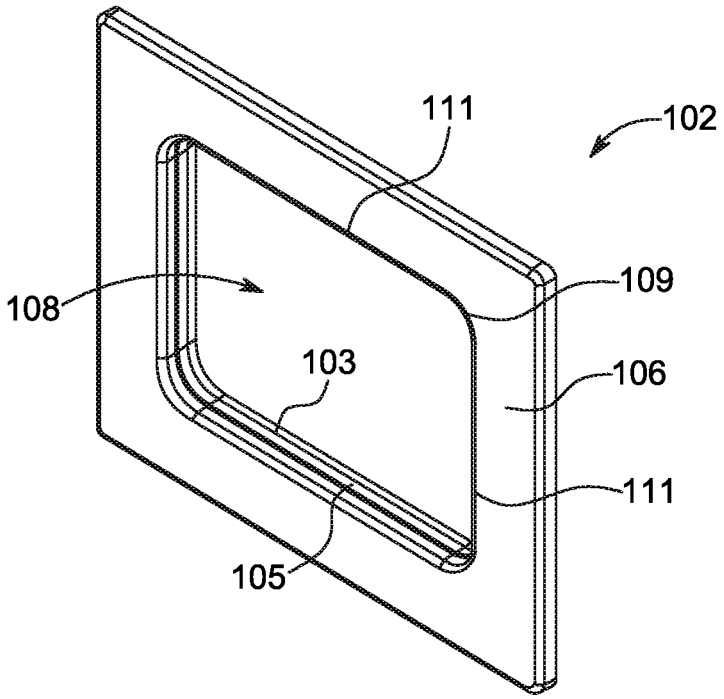
FIG. 3 is a front perspective view of a closure faceplate in accordance with some embodiments or aspects of the present disclosure.

With reference to FIG. 3, the closure faceplate 102 has a sidewall 106 defining an outer peripheral shape of the closure faceplate 102. The sidewall 106 has a central opening 108 with a flange 103 (shown in FIG. 2) that extends around an inner periphery of the central opening 108 and protrudes rearwardly relative to the sidewall 106. In some aspects, at least a portion of the flange 103 may be inserted into the skimmer opening 101 such that the sidewall 106 overlaps at least a portion of the skimmer opening 101 in order to prevent movement of the closure faceplate 102 into the skimmer opening 101. In other aspects, at least a portion of the flange 103 may interact with the skimmer peripheral flange 107 (shown in FIG. 1) such that the sidewall 106 overlaps at least a portion of the skimmer opening 101 and/or the skimmer peripheral flange 107. In further examples, the flange 103 may narrow or widen in a direction from away from an outer surface of the sidewall 106 toward the skimmer opening 101. In other examples, the flange 103 may be substantially perpendicular to the sidewall 106.

With reference to FIGS. 1-2, in some embodiments or aspects, the sidewall 106 of the closure faceplate 102 may have one or more through-holes 111 configured to receive a fastener element (not shown), such as a screw, to connect the closure faceplate 102 to the skimmer opening 101 and/or the skimmer peripheral flange 107. In further embodiments or aspects, the closure faceplate 102 may be connected to the skimmer opening 101 and/or the skimmer peripheral flange 107 by an adhesive. The underside of the closure faceplate 102 could have several undercut notched areas (not shown) formed therein to permit the insertion of a removal tool, such as a screwdriver tip, to permit removal of the closure faceplate 102 from the skimmer opening 101 and the skimmer peripheral flange 107, if desired.

Figure 4:
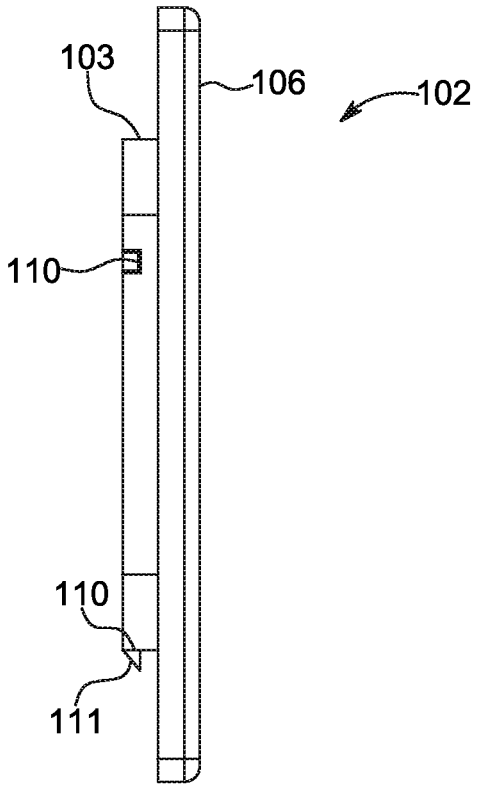
FIG. 4 is a side view of the closure faceplate shown in FIG. 3.

The closure faceplate 102 may be removably or non-removably connected to the skimmer opening 101 and/or the skimmer peripheral flange 107. With specific reference to FIGS. 4 and 6, in some embodiments or aspects, the flange 103 of the closure faceplate 102 has one or more locking elements 110 configured to connect with the skimmer peripheral flange (not shown) installed around the skimmer opening 101. The one or more locking elements 110 may be formed at an outer periphery of the flange 103. In some embodiments or aspects, the one or more locking elements 110 may formed as tabs that snap over the skimmer peripheral flange installed around the skimmer opening 101. At least a portion of the flange 103 may be flexible to allow the one or more locking elements 110 to be deflected such that they can pass over the skimmer peripheral flange. Alternatively, the flange 103 may be rigid, while the one or more locking elements 110 may flex or deflect relative to the flange 103 to allow the closure faceplate 102 to be connected to the skimmer peripheral flange installed around the skimmer opening 101. In some embodiments or aspects, the flange 103 and/or the one or more locking elements 110 may be movable between a first, undeflected position and a second, deflected position. Once the one or more locking elements 110 clear the skimmer peripheral flange, the one or more locking elements 110 may snap back to the initial, undeflected position. One of ordinary skill in the art will appreciate that the one or more locking elements 110 may be formed as tabs, snaps, or other fastening elements that connect the closure faceplate 102 to the skimmer peripheral flange 107.

Figure 5:
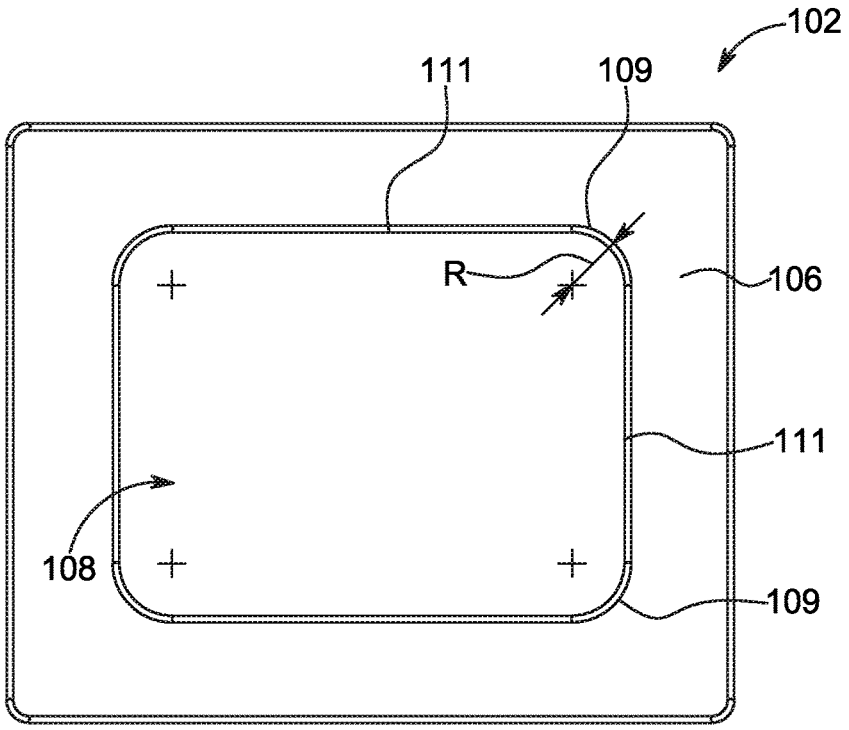
FIG. 5 is a front view of the closure faceplate shown in FIG. 3.
Figure 6:
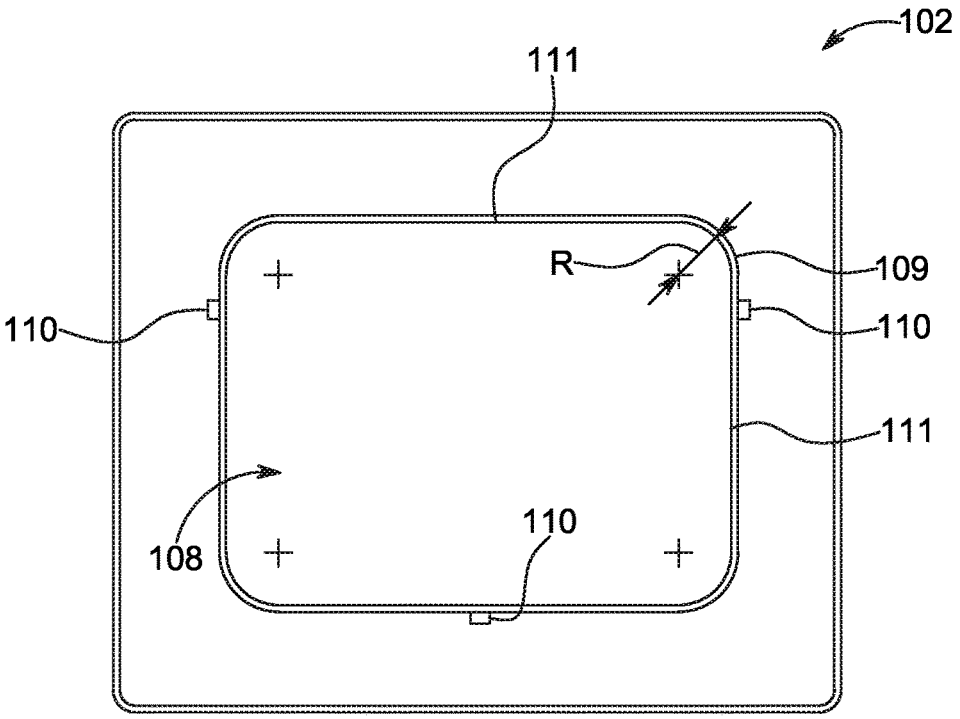
FIG. 6 is a rear view of the sealing closure assembly shown in FIG. 3.

With reference to FIGS. 5-6, the closure faceplate 102 may have one or more radiused corners 109 at apex locations of the central opening 108. In some aspects, the radiused corners 109 may be provided to ease the transition between the adjoining linear or substantially linear portions 111 of the closure faceplate 102 to provide a better sealing interface with the sealing gasket of the cover 104, as described herein. For example, the radiused corners 109 may have a radius R between 0.25" to 1" and may join to linear or substantially linear portions that are oriented at a substantially perpendicular angle. In this manner, the radiused corners 109 provide a smooth transition between the adjoining linear or substantially portions 111 in the corners of the central opening 108 to prevent leakage of water.

In some embodiments or aspects, the closure faceplate 102 is formed as a one-piece integral member formed from a rigid material. For example, the closure faceplate 102 may be injection molded from a hard plastic material, such as an ABS plastic resin that resists dimensional shrinking due to temperature variations. In other aspects, the closure faceplate 102 may be formed from metal, composite material, such as carbon fiber, or a combination of metal, plastic, and/or composite materials. In various aspects, the closure faceplate 102 is made from a rigid material capable of resisting stretching or breaking due to contact with ice which may form in the pool.

Figure 7:
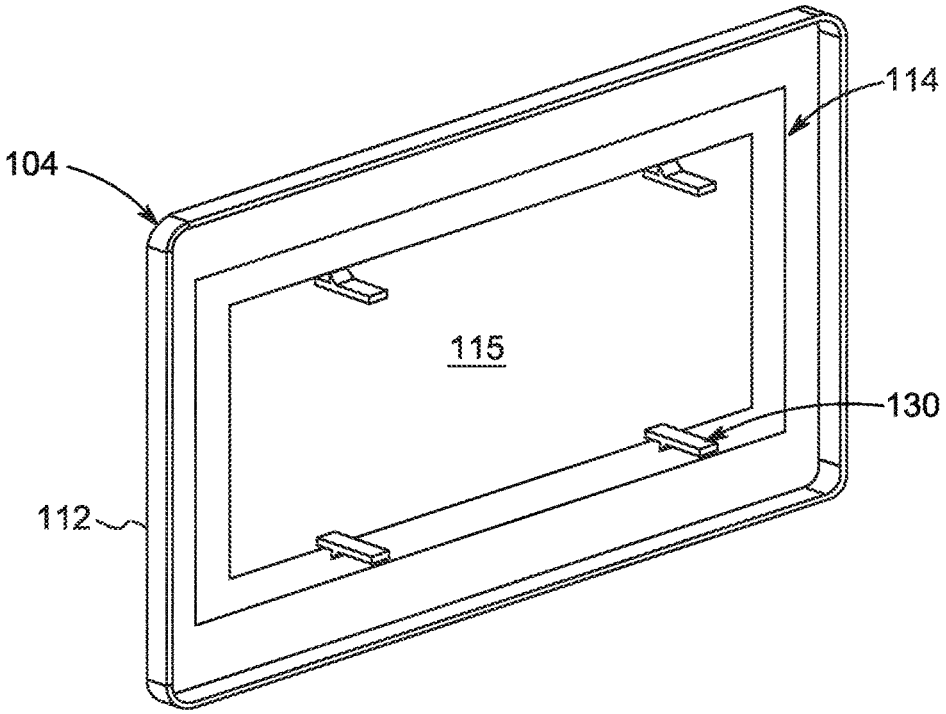
FIG. 7 is a rear view of a cover in accordance with some embodiments or aspects of the present disclosure.

With reference to FIGS. 1-2, the cover 104 is configured to be removably secured to the closure faceplate 102 to enclose the central opening 108 and prevent passage of water through the central opening 108 and into the skimmer opening 101. The cover 104 has a cover plate 112 that is shaped to correspond to the central opening 108 of the closure faceplate 102. As shown in FIG. 7, a sealing gasket 114 extends around an inner surface 115 of the cover plate 112. The cover plate 112, together with the sealing gasket 114, is configured to abut the outer surface of the sidewall 106 of the closure faceplate 102. For example, the cover plate 112 may be configured to interface with the closure faceplate 102, such that the sealing gasket 114 contacts the outer or pool-side facing surface of the sidewall 106 for a watertight seal between the cover plate 112 and the closure faceplate 102.

With reference to FIG. 7, the sealing gasket 114 of the cover 104 may be dimensioned such that the sealing gasket 114 has a shape that corresponds to the shape of the sidewall 106 of the closure faceplate 102. That is, the sealing gasket 114 of the cover 104 may have one or more linear or substantially linear portions that correspond to the one or more linear or substantially linear portions 111 of the closure faceplate 102 and one or more radiused portions with a radius that substantially corresponds to the radius R of the radiused corners 109 of the closure faceplate 102. The sealing gasket 114 may be a monolithic component, or it may be comprised of two or more separate elements. In some aspects, the sealing gasket 114 is formed separately from the cover plate 112 and is removably or non-removably installed on the cover plate 112. In other aspects, the sealing gasket 114 is formed together with the cover plate 112, such as by co-molding. In some aspects, the sealing gasket 114 may be formed from a resilient material, such as a thermoplastic elastomer, which remains flexible in varying temperature settings and is resistant to degradation over time. The sealing gasket 114 may be formed, for example, by injection molding, or, as noted above, by co-molding with the cover plate 112.

With continued reference to FIG. 7, the cover 104 has a lip 120 protruding from the inner surface 115 of the cover plate 112. The lip 120 is shaped to correspond to the shape of an outer periphery of the closure faceplate 102. When the cover 104 is installed on the closure faceplate 102, the lip 120 may be configured to conceal the closure faceplate 102.

With continued reference to FIG. 7, the cover 104 has at least one closure member 130 on the cover plate 112 for locking the cover plate 112 to the closure faceplate 102. As described herein, the at least one closure member 130 is positioned such that it is configured to interface with at least a portion of the closure faceplate 102. When the at least one closure member 130 is connected to the closure faceplate 102, the cover 104 is locked to the closure faceplate 102 to prevent ingress of water into the skimmer opening.

The at least one closure member 130 includes a body 132 having a first end 134 connected to the cover plate 112 and a second end 136 protruding relative to the first end 134. In some embodiments or aspects, the body 132 of the at least one closure member 130 may protrude in a direction substantially perpendicular to a plane defined by the cover plate 112. The second end 136 of the at least one closure member 130 is deflectable relative to the first end 134. For example, the second end 136 of the at least one closure member 130 may be resiliently deflectable relative to the first end 134 such that the second end 136 reverts back to its initial position after being laterally displaced relative to the first end 134.

In some embodiments or aspects, the at least one closure member 130 is four closure members 130 positioned to engage four corners of the flange 103 of the closure faceplate 102. The bodies 132 of the closure members 130 may be spaced apart from each other by a distance corresponding to a width of the central opening 108 of the closure faceplate 108.

Figure 8:
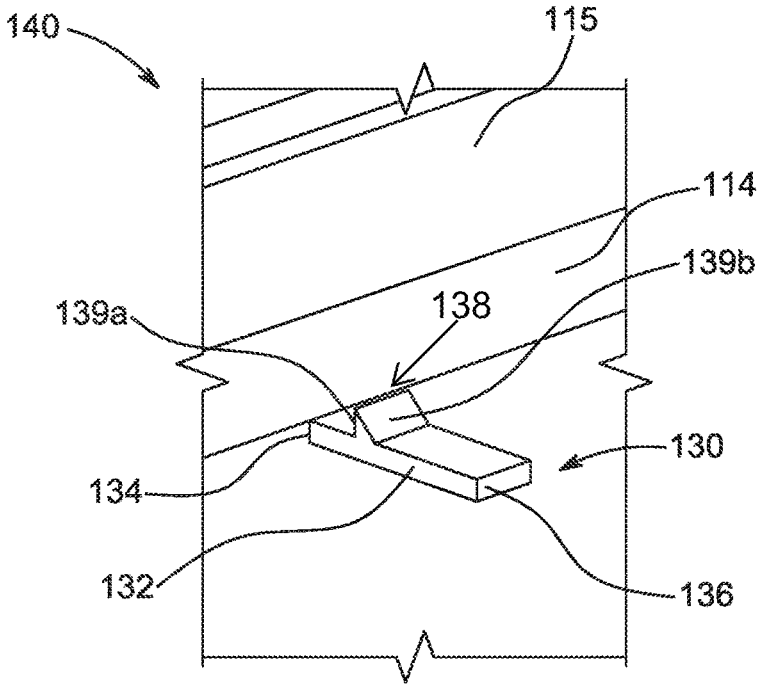
FIG. 8 is a detailed view of a closure member on the cover shown in FIG. 7.

With reference to FIG. 8, the at least one closure member 130 has a locking member 138 between the first end 134 and the second end 136. The locking member 138 is configured for engaging with the flange 103 of the closure faceplate 102 when the cover 104 is connected to the closure faceplate 102. In some embodiments or aspects, the locking member 138 is a notch that protrudes from the body 132 of the at least one closure member 130. The locking member 138 has a proximal edge 139*a* that faces the inner surface of the cover plate 112 and a distal edge 139*b* that faces away from the inner surface of the cover plate 112. In some embodiments or aspects, the proximal edge 139*a* may be substantially parallel to a plane defined by the cover plate 112, while the distal edge 139*b* may be angled relative to the plane of the cover plate 112. The locking member 138 is spaced apart from the first end 134 by a distance corresponding to a thickness of the flange 103. In this manner, when the at least one closure member 130 is connected to the closure faceplate 102, the flange 103 of the closure faceplate 102 is captured between the first end 134 and the locking member 138.

In some embodiments or aspects, the cover 104 is formed as a one-piece integral member formed from a rigid material. For example, the cover 104 may be injection molded from a hard plastic material, such as an ABS plastic resin that resists dimensional shrinking due to temperature variations. In other aspects, the cover 104 may be formed from metal, composite material, such as carbon fiber, or a combination of metal, plastic, and/or composite materials. In various aspects, the cover 104 is made from a rigid material capable of resisting stretching or breaking due to contact with ice which may form in the pool.

Having described the structure of the sealing closure assembly 100, a method of installing the sealing closure assembly 100 to close the skimmer opening 101 and prevent the passage of water into the skimmer opening 101 will now be described. To install the sealing closure assembly 100, the closure faceplate 102 is first installed on the skimmer opening 101, for example by snapping the closure faceplate 102 such that the one or more locking elements 110 lockingly engage the closure faceplate 102 with the skimmer peripheral flange 107. In various other aspects, the closure faceplate 102 may be installed on the skimmer peripheral flange 107 by one or more fasteners, adhesive, or any other mechanical connection means that securely retains the closure faceplate 102 on the skimmer peripheral flange 107. When installed, the closure faceplate 102 surrounds the skimmer opening 101 such that obstructing the central opening 108 of the closure faceplate 102 also obstructs the skimmer opening 101.

Figure 9:
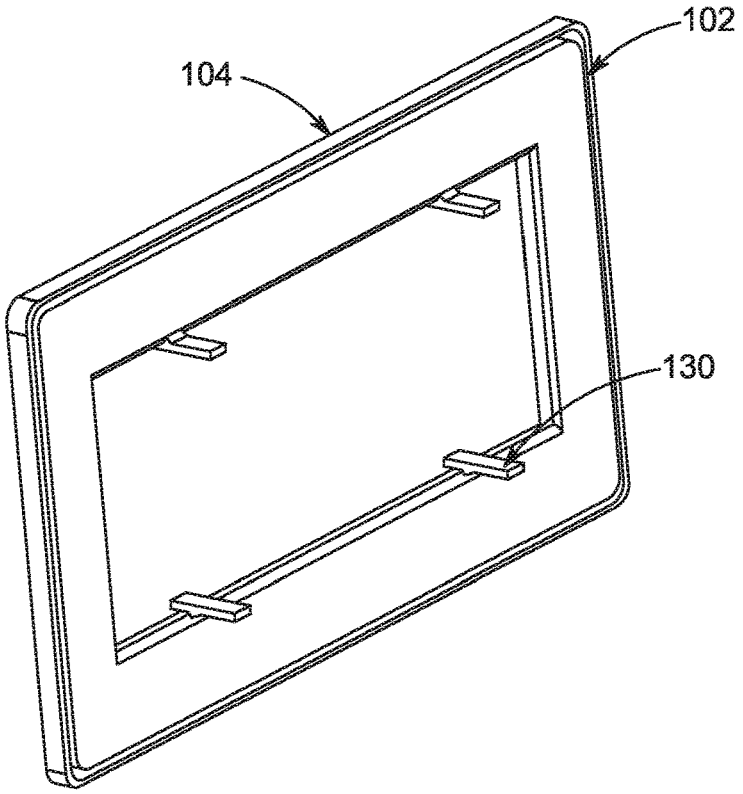
FIG. 9 is a rear view of the cover shown in FIG. 7 and a closure faceplate.
Figure 10:
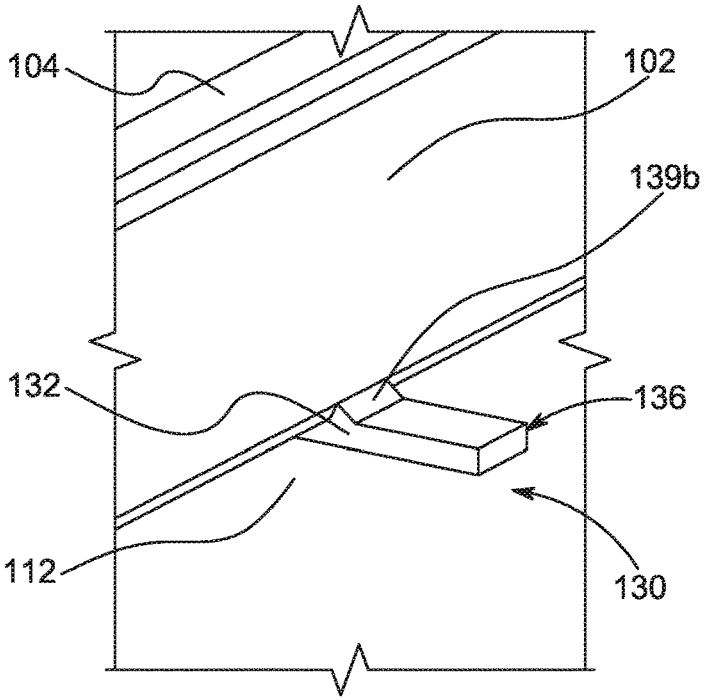
FIG. 10 is a detailed view of the interaction between the closure member on the cover and the closure faceplate shown in FIG. 9.

Next, the cover 104 is connected to the closure faceplate 102 such that the second ends 136 of the one or more closure members 130 on the cover 104 extend into the central opening 108 of the closure faceplate 102. During installation of the cover 104 onto the closure faceplate 102, the distal edges 139*b* of each of the locking members 138 contacts the flange 103 of the closure faceplate 102 such that the second end 136 of the closure members 130 is deflected from an initial position to a deflected position. With continued movement of the cover 104 toward the closure faceplate 102, the distal edges 139*b* of each of the closure members 130 pass over the flange 103 of the closure faceplate 102 such that the closure faceplate 102 is captured between the proximal edge 139*a* and the inner surface of the cover plate 112 (see FIGS. 9-10). In this position, the second end 136 of the closure members 130 is deflected from the deflected position back to the initial, undeflected position. Furthermore, the sealing gasket 114 seals the interface between the cover plate 112 and the closure faceplate 102 to prevent ingress of water through the central opening 108 of the closure faceplate 102. In this manner, the cover 104 is securely fastened to the closure faceplate 102 and ingress of water into the central opening 108 of the closure faceplate 102 and into the skimmer opening is prevented. To remove the cover 104 from the closure faceplate 102, the second ends 136 of the closure members 130 are deflected away from the flange 103 of the closure faceplate 102 to permit the locking member 140 to pass over the flange 103 as the cover 104 is moved in a direction away from the closure faceplate 102. For example, the second ends 136 of the closure members 130 may be accessed through a skimmer opening on the pool deck.

While specific embodiments or aspects of the invention have been described in detail, it will be appreciated by those skilled in the art that various modifications and alternatives to those details could be developed in light of the overall teachings of the disclosure. The presently preferred embodiments or aspects described herein are meant to be illustrative only and not limiting as to the scope of the invention which is to be given the full breadth of the appended claims and any and all equivalents thereof.

The invention claimed is:

1. A sealing closure assembly for closing a skimmer opening of a swimming pool, the sealing closure assembly comprising:

a closure faceplate comprising:

a sidewall with a central opening shaped to correspond to the skimmer opening; and a flange protruding from an inner periphery of the central opening of the sidewall to overlap a peripheral area of the skimmer opening, and a cover removably connectable to the closure faceplate to seal the central opening of the closure faceplate, the cover comprising:

a cover plate configured for engaging at least a portion of the sidewall of the closure faceplate;

a sealing gasket extending around an inner surface of the cover plate; and at least one closure member on the cover plate inwardly of the sealing gasket for locking the cover plate to the closure faceplate, the at least one closure member comprising:

a body having a first end connected to the cover plate and a second end protruding relative to the first end, wherein the second end of the at least one closure member is deflectable relative to the first end; and a locking member between the first end and the second end, the locking member configured for engaging with the flange of the closure faceplate when the cover is connected to the closure faceplate.

2. The sealing closure assembly of claim 1, wherein the locking member is a notch protruding from the body of the at least one closure member.

3. The sealing closure assembly of claim 1, wherein the at least one locking member is four locking members positioned to engage four corners of the flange of the closure faceplate.

4. The sealing closure assembly of claim 1, wherein the second end of the at least one closure member is resiliently deflectable relative to the first end.

5. The sealing closure assembly of claim 1, wherein the sealing gasket is dimensioned such that a shape of the sealing gasket corresponds to a shape of the sidewall of the closure faceplate, and wherein the sealing gasket is configured for abutting the sidewall of the closure faceplate when the cover is connected to the closure faceplate.

6. The sealing closure assembly of claim 1, wherein the sealing gasket is molded over the cover plate.

7. The sealing closure assembly of claim 1, wherein the sealing gasket is monolithically formed with the cover plate.

8. The sealing closure assembly of claim 1, wherein the sealing gasket is made of a thermoplastic elastomer material.

9. The sealing closure assembly of claim 1, further comprising one or more locking elements on the flange for connecting to a peripheral flange on the skimmer opening.

10. The sealing closure assembly of claim 9, wherein each of the one or more locking elements is formed on an outer periphery of the flange.

11. The sealing closure assembly of claim 1, wherein the closure faceplate has one or more radiused corners defining the central opening.

12. The sealing closure assembly of claim 11, wherein a radius of the one or more radiused corners is between 0.25 inches and 1 inches.

13. The sealing closure assembly of claim 1, wherein the closure faceplate and cover plate are made of an injection molded plastic material.

14. A cover element for closing a skimmer opening of a swimming pool skimmer, the cover element comprising:

a cover plate configured for engaging at least a portion of a sidewall of a closure faceplate;

a sealing gasket extending around an inner surface of the cover plate; and at least one closure member on the cover plate inwardly of the sealing gasket for locking the cover plate to the closure faceplate, the at least one closure member comprising:

a body having a first end connected to the cover plate and a second end protruding relative to the first end, wherein the second end of the at least one closure member is deflectable relative to the first end; and a locking member between the first end and the second end, the locking member configured for engaging with the flange of the closure faceplate when the cover is connected to the closure faceplate.

15. The cover element of claim 14, wherein the locking member is a notch protruding from the body of the at least one closure member.

16. The cover element of claim 14, wherein the second end of the at least one closure member is resiliently deflectable relative to the first end.

17. The cover element of claim 14, wherein the cover plate is made of an injection molded plastic material.

18. The cover element of claim 14, wherein the sealing gasket is made of a thermoplastic elastomer material.

* * * * *